US009131571B2

(12) United States Patent
Zhang et al.

(10) Patent No.: US 9,131,571 B2
(45) Date of Patent: Sep. 8, 2015

(54) SOLID-STATE LIGHTING APPARATUS AND METHODS USING ENERGY STORAGE WITH SEGMENT CONTROL

(75) Inventors: Jun Zhang, Cary, NC (US); Liqin Ni, Cary, NC (US)

(73) Assignee: Cree, Inc., Durham, NC (US)

( * ) Notice: Subject to any disclaimer, the term of this patent is extended or adjusted under 35 U.S.C. 154(b) by 123 days.

(21) Appl. No.: 13/616,368

(22) Filed: Sep. 14, 2012

(65) Prior Publication Data

US 2014/0077709 A1 Mar. 20, 2014

(51) Int. Cl.
*H05B 37/00* (2006.01)
*H05B 33/08* (2006.01)

(52) U.S. Cl.
CPC ..... *H05B 33/0824* (2013.01); *H05B 33/083* (2013.01)

(58) Field of Classification Search
USPC ..... 315/188, 185 R, 193, 294, 297, 122, 123
See application file for complete search history.

(56) References Cited

U.S. PATENT DOCUMENTS

| | | | |
|---|---|---|---|
| 4,504,776 | A | 3/1985 | Haville |
| 4,581,542 | A | 4/1986 | Steigerwald |
| 4,798,983 | A | 1/1989 | Mori |
| 4,839,535 | A | 6/1989 | Miller |
| 5,015,836 | A | 5/1991 | Van Antwerp |
| 5,059,890 | A | 10/1991 | Yoshikawa et al. |
| 5,397,938 | A | 3/1995 | Wilhelm et al. |
| 5,446,366 | A | 8/1995 | Bassett et al. |
| 5,504,448 | A | 4/1996 | Bennett et al. |
| 5,598,068 | A | 1/1997 | Shirai |
| 5,803,579 | A | 9/1998 | Turnbull et al. |
| 5,941,626 | A | 8/1999 | Yamuro |
| 6,381,151 | B1 | 4/2002 | Jang |
| 6,556,067 | B2 | 4/2003 | Henry |

(Continued)

FOREIGN PATENT DOCUMENTS

| | | |
|---|---|---|
| CN | 201700061 | 1/2011 |
| JP | 2007-059205 | 3/2007 |

(Continued)

OTHER PUBLICATIONS

International Search Report Corresponding to International Application No. PCT/US2012/065533; Date of Mailing: Feb. 5, 2013; 11 Pages.

(Continued)

*Primary Examiner* — Daniel D Chang
(74) *Attorney, Agent, or Firm* — Myers Bigel Sibley & Sajovec, P.A.

(57) ABSTRACT

A lighting apparatus includes a rectifier circuit configured to be coupled to an AC source and to produce a rectified voltage from an AC voltage and a string including at least two serially-connected LED segments and coupled to the rectifier circuit. A segment control circuit is configured to selectively bypass at least one segment of the string responsive to the rectified voltage. An energy storage circuit is coupled to the rectifier circuit and controls current flow between at least one energy storage device and the string. A control circuit controls the segment control circuit and the energy storage circuit. The segment control circuit may support a current from the rectifier circuit through all of the segments in the string circuit at a peak of the rectified voltage and the energy storage circuit may charge the at least one energy storage device to a voltage near the peak of the rectified voltage.

34 Claims, 12 Drawing Sheets

(56) References Cited

U.S. PATENT DOCUMENTS

| | | | | |
|---|---|---|---|---|
| 6,621,235 | B2 | 9/2003 | Chang | |
| 7,088,059 | B2 | 8/2006 | McKinney et al. | |
| 7,102,339 | B1 | 9/2006 | Ferguson | |
| 7,345,894 | B2 | 3/2008 | Sawtell et al. | |
| 7,427,838 | B2 | 9/2008 | Hosoya | |
| 7,781,979 | B2 | 8/2010 | Lys | |
| 7,804,256 | B2 | 9/2010 | Melanson | |
| 7,902,771 | B2 * | 3/2011 | Shteynberg et al. | 315/307 |
| 7,994,725 | B2 | 8/2011 | Bouchard | |
| 8,299,724 | B2 * | 10/2012 | Huynh | 315/291 |
| 8,587,211 | B2 | 11/2013 | Melanson | |
| 2002/0097095 | A1 | 7/2002 | Jeon et al. | |
| 2002/0163371 | A1 | 11/2002 | Hall et al. | |
| 2004/0036418 | A1 | 2/2004 | Rooke et al. | |
| 2004/0046510 | A1 | 3/2004 | Allen | |
| 2004/0208009 | A1 | 10/2004 | Mardon et al. | |
| 2005/0007164 | A1 | 1/2005 | Callahan, Jr. | |
| 2005/0052165 | A1 | 3/2005 | Willner et al. | |
| 2005/0057179 | A1 | 3/2005 | Madhani et al. | |
| 2005/0174065 | A1 | 8/2005 | Janning | |
| 2005/0242742 | A1 | 11/2005 | Cheang et al. | |
| 2006/0125454 | A1 | 6/2006 | Chen et al. | |
| 2006/0186866 | A1 | 8/2006 | Sharma | |
| 2006/0244396 | A1 | 11/2006 | Bucur | |
| 2007/0096661 | A1 | 5/2007 | Allen | |
| 2007/0103949 | A1 | 5/2007 | Tsuruya | |
| 2007/0108843 | A1 | 5/2007 | Preston et al. | |
| 2007/0182338 | A1 | 8/2007 | Shteynberg et al. | |
| 2007/0182346 | A1 | 8/2007 | Shteynberg et al. | |
| 2007/0182347 | A1 | 8/2007 | Shteynberg et al. | |
| 2007/0257623 | A1 | 11/2007 | Johnson et al. | |
| 2007/0267978 | A1 | 11/2007 | Shteynberg et al. | |
| 2007/0273299 | A1 | 11/2007 | Miskin et al. | |
| 2007/0285031 | A1 | 12/2007 | Shteynberg et al. | |
| 2008/0067993 | A1 | 3/2008 | Coleman | |
| 2008/0094000 | A1 | 4/2008 | Yamamoto et al. | |
| 2008/0116818 | A1 | 5/2008 | Shteynberg et al. | |
| 2008/0129220 | A1 | 6/2008 | Shteynberg et al. | |
| 2008/0211415 | A1 | 9/2008 | Altamura | |
| 2008/0272748 | A1 | 11/2008 | Melanson | |
| 2009/0079355 | A1 | 3/2009 | Zhou et al. | |
| 2009/0079357 | A1 | 3/2009 | Shteynberg et al. | |
| 2009/0079358 | A1 | 3/2009 | Shteynberg et al. | |
| 2009/0079359 | A1 | 3/2009 | Shteynberg et al. | |
| 2009/0079360 | A1 | 3/2009 | Shteynberg et al. | |
| 2009/0079362 | A1 | 3/2009 | Shteynberg et al. | |
| 2009/0170226 | A1 | 7/2009 | Wall, Jr. | |
| 2009/0184662 | A1 | 7/2009 | Given et al. | |
| 2009/0195168 | A1 | 8/2009 | Greenfield | |
| 2009/0251934 | A1 | 10/2009 | Shteynberg et al. | |
| 2009/0261748 | A1 | 10/2009 | McKinney et al. | |
| 2010/0007999 | A1 | 1/2010 | Iwata | |
| 2010/0026208 | A1 | 2/2010 | Shteynberg et al. | |
| 2010/0045187 | A1 | 2/2010 | Shteynberg et al. | |
| 2010/0045210 | A1 | 2/2010 | Hariharan | |
| 2010/0060175 | A1 | 3/2010 | Lethellier | |
| 2010/0079262 | A1 | 4/2010 | Van Laanen | |
| 2010/0109537 | A1 | 5/2010 | Nishino et al. | |
| 2010/0109557 | A1 | 5/2010 | Bouchard | |
| 2010/0123978 | A1 | 5/2010 | Lin et al. | |
| 2010/0134018 | A1 | 6/2010 | Tziony et al. | |
| 2010/0164406 | A1 | 7/2010 | Kost et al. | |
| 2010/0194274 | A1 | 8/2010 | Hoogzaad | |
| 2010/0201336 | A1 | 8/2010 | Chen | |
| 2010/0207150 | A1 | 8/2010 | Grajcar | |
| 2010/0213859 | A1 | 8/2010 | Shteynberg et al. | |
| 2010/0231135 | A1 | 9/2010 | Hum et al. | |
| 2010/0264832 | A1 | 10/2010 | Archenhold et al. | |
| 2010/0308738 | A1 | 12/2010 | Shteynberg et al. | |
| 2010/0308739 | A1 | 12/2010 | Shteynberg et al. | |
| 2010/0309689 | A1 | 12/2010 | Coulson | |
| 2011/0025217 | A1 | 2/2011 | Zhan et al. | |
| 2011/0068701 | A1 | 3/2011 | van de Ven et al. | |
| 2011/0074292 | A1 | 3/2011 | Maehara | |
| 2011/0095691 | A1 | 4/2011 | Nakajo et al. | |
| 2011/0109228 | A1 | 5/2011 | Shimomura et al. | |
| 2011/0109244 | A1 | 5/2011 | Grajcar | |
| 2011/0115394 | A1 | 5/2011 | Shteynberg et al. | |
| 2011/0115411 | A1 | 5/2011 | Shteynberg et al. | |
| 2011/0121754 | A1 | 5/2011 | Shteynberg et al. | |
| 2011/0148200 | A1 | 6/2011 | Burns et al. | |
| 2011/0149614 | A1 | 6/2011 | Stracquadaini | |
| 2011/0193467 | A1 | 8/2011 | Grajcar | |
| 2011/0210678 | A1 | 9/2011 | Grajcar | |
| 2011/0227484 | A1 | 9/2011 | Huynh | |
| 2011/0227485 | A1 | 9/2011 | Huynh | |
| 2011/0227489 | A1 | 9/2011 | Huynh | |
| 2011/0227490 | A1 * | 9/2011 | Huynh | 315/185 R |
| 2011/0248640 | A1 | 10/2011 | Welton | |
| 2011/0273102 | A1 | 11/2011 | van de Ven et al. | |
| 2011/0279044 | A1 | 11/2011 | Maiw | |
| 2012/0013259 | A1 | 1/2012 | Jin | |
| 2012/0049825 | A1 | 3/2012 | Chen et al. | |
| 2012/0091920 | A1 | 4/2012 | Yang | |
| 2012/0099321 | A1 | 4/2012 | Scott et al. | |
| 2012/0319604 | A1 | 12/2012 | Walters | |
| 2013/0162149 | A1 | 6/2013 | Van de Ven et al. | |
| 2013/0241430 | A1 | 9/2013 | Lee et al. | |
| 2013/0307415 | A1 | 11/2013 | Ni | |
| 2014/0043877 | A1 | 2/2014 | Ishii | |
| 2014/0049181 | A1 | 2/2014 | Kelly et al. | |
| 2014/0091724 | A1 | 4/2014 | Palmer | |

FOREIGN PATENT DOCUMENTS

| | | |
|---|---|---|
| JP | 2008-130523 | 6/2008 |
| JP | 2010-187429 | 8/2010 |

OTHER PUBLICATIONS

L6561 Power Factor Corrector. Datasheet, STMicroelectronic. Jun. 2004, retrieved from the internet (Apr. 10, 2013), URL: http://dalincom.ru/datasheet/L6561.pdf.

International Preliminary Report on Patentability Corresponding to International Application No. PCT/US2011/033736; Date of Mailing: Nov. 22, 2012; 8 Pages.

International Search Report Corresponding to International Application No. PCT/US12/54869; Date of Mailing: Nov. 23, 2012; 10 Pages.

International Search Report Corresponding to International Application No. PCT/US2012/054384; Date of Mailing: Nov. 26, 2012; 13 Pages.

International Search Report Corresponding to International Application No. PCT/US12/47643; Date of Mailing: Oct. 25, 2012; 10 Pages.

International Search Report Corresponding to International Application No. PCT/US12/54888; Date of Mailing: Nov. 23, 2012; 12 Pages.

International Search Report Corresponding to International Application No. PCT/US2012/047344; Date of Mailing: Dec. 3, 2012; 16 Pages.

U.S. Appl. No. 13/235,103, filed Sep. 16, 2011.

U.S. Appl. No. 13/405,891, filed Feb. 27, 2012.

Notification of Transmittal of the International Search Report and the Written Opinion of the International Searching Authority, or the Declaration, PCT/US13/58682, Date of Mailing: Feb. 7, 2014, 21 pages.

Notification of Transmittal of the International Search Report and the Written Opinion of the International Searching Authority, or the Declaration, PCT/US2013/067211, Date of Mailing: Mar. 27, 2014, 13 pages.

* cited by examiner

SOLID-STATE LIGHTING APPARATUS AND METHODS USING ENERGY STORAGE WITH SEGMENT CONTROL

FIELD

The present inventive subject matter relates to lighting apparatus and methods and, more particularly, to solid-state lighting apparatus and methods.

BACKGROUND

Solid-state lighting arrays are used for a number of lighting applications. For example, solid-state lighting panels including arrays of solid-state light emitting devices have been used as direct illumination sources in architectural and/or accent lighting. A solid-state light emitting device may include, for example, a packaged light emitting device including one or more light emitting diodes (LEDs), which may include inorganic LEDs, which may include semiconductor layers forming p-n junctions and/or organic LEDs (OLEDs), which may include organic light emission layers.

Solid-state lighting devices are also used in lighting fixtures, such as incandescent bulb replacement applications, task lighting, recessed light fixtures and the like. For example, Cree, Inc. produces a variety of recessed downlights, such as the LR-6 and CR-6, which use LEDs for illumination. Solid-state lighting panels are also commonly used as backlights for small liquid crystal display (LCD) screens, such as LCD display screens used in portable electronic devices, and for larger displays, such as LCD television displays.

Some attempts at providing solid-state lighting sources have involved driving an LED or string or group of LEDs using a rectified voltage produced from an AC source. However, because the LEDs generally require a minimum forward voltage to turn on, the LEDs may turn on for only a part of the rectified AC waveform, which may result in visible flickering, may undesirably lower the power factor of the system, and/or may increase resistive loss in the system. Examples of techniques for driving LEDs with a rectified AC waveform are described in U.S. Patent Application Publication No. 2010/0308738. Co-pending U.S. patent application Ser. No. 13/235,103, entitled "Solid-State Lighting Apparatus and Methods Using Energy Storage", filed Sep. 16, 2011 and Ser. No. 13/405,819, entitled "Solid-State Lighting Apparatus and Methods Using Energy Storage", filed Feb. 27, 2012, each of which is commonly assigned to the assignee of the present application, describe techniques in which a capacitor or other energy storage device may be used to sustain light output during nulls of the waveform of an AC power source used to power a lighting apparatus.

SUMMARY

Some embodiments provide a lighting apparatus including a string including at least two serially-connected segments, each including at least one light-emitting diode (LED). The string is configured to be coupled to a source of a varying voltage. A segment control circuit is configured to selectively bypass at least one segment of the string responsive to the varying voltage. The apparatus also includes an energy storage circuit configured to charge at least one energy storage device from the source of varying voltage and to control current flow between the at least one energy storage device and the string. The apparatus further includes a control circuit configured to control the segment control circuit and the energy storage circuit responsive to the varying voltage such that the at least one energy storage device is selectively coupled in parallel with different sets of the segments responsive to the varying voltage.

In some embodiments, the control circuit may be configured to control the segment control circuit and the energy storage circuit to couple the at least one energy storage device in parallel with a first set of the segments to charge the at least one charge storage device and to discharge the at least one charge storage through a second set of the segments. The second set of segments may include fewer segments than the first set of segments, e.g., the second set of segments may be a subset of the first set of segments.

In some embodiments, the second set of segments may include a segment having a greatest number of LEDs. For example, the second set of segments may include a segment having a greatest number of LEDs connected in parallel.

In some embodiments, the apparatus further includes a rectifier circuit configured to be coupled to an AC source and to produce a rectified voltage from an AC voltage produced by the AC source. The string may be coupled to the rectifier circuit. The segment control circuit may be configured to selectively bypass the segments of the string responsive to the rectified voltage and the control circuit may be configured to cause the segment control circuit to bypass at least one of the segments of the string when the rectified voltage is insufficient to cause forward conduction through at least one of the segments. The control circuit may be further configured to cause the energy storage circuit to provide current from the at least one energy storage device to at least one unbypassed segment of the string when the rectified voltage is insufficient to cause forward conduction through at least one of the segments.

According to further embodiments, the control circuit may be configured to cause the energy storage circuit to charge the at least one energy storage device responsive to a magnitude of the varying voltage exceeding a threshold and to discharge the at least one energy storage device responsive to the magnitude of the varying voltage falling below the threshold.

In some embodiments, the apparatus may further include a dimming control circuit configured to control a current passing through at least one of the segments responsive to a dimming control input. The segment control circuit may include at least one current control circuit coupled to a node of the string and the dimming control circuit may be configured to control current flow through the at least one current control circuit.

Further embodiments of the inventive subject matter provide a lighting apparatus including a rectifier circuit configured to be coupled to an AC source and to produce a rectified voltage from an AC voltage produced by the AC source, and a string including at least two serially-connected LED segments and coupled to the rectifier circuit. A segment control circuit is configured to selectively bypass at least one segment of the string responsive to the rectified voltage. The apparatus further includes an energy storage circuit coupled to the rectifier circuit and configured to control current flow between at least one energy storage device and the string. A control circuit is configured to control the segment control circuit and the energy storage circuit such that the at least one energy storage device is charged by the rectifier circuit when a magnitude of the rectified voltage is greater than a threshold and discharged through less than all of the segments of the string when the magnitude of the rectified voltage is less than the threshold. The segment control circuit may be configured to support a current from the rectifier circuit through all of the segments in the string circuit at a peak of the rectified voltage and the energy storage circuit may be configured to charge the at least one energy storage device to a voltage near the peak of the rectified voltage.

In some embodiments, the segment control circuit may include at least one current control circuit and wherein the control circuit is configured to control the at least one current control circuit to bypass at least one of the segments of the string when the rectified voltage is less than the threshold.

In some embodiments, the apparatus may further include a dimming control circuit coupled to the segment control circuit and configured to control a current passing through at least one of the segments responsive to a dimming control input. The segment control circuit may include at least one current control circuit coupled to a node of the string and configured to control current flow from the node responsive to a control signal. The dimming control circuit may be configured to generate the control signal. The dimming control circuit may be configured to generate the control signal responsive to a phase cut of the AC voltage.

Further embodiments of the inventive subject matter provide an apparatus including a segment control circuit configured to be coupled to a string including at least two serially-connected LED segments and to selectively bypass at least one segment of the string responsive to a varying voltage. An energy storage circuit is configured to charge at least one energy storage device from the source of varying voltage and to control current flow between the at least one energy storage device and the string. A control circuit is configured to control the segment control circuit and the energy storage circuit responsive to the varying voltage such that the at least one energy storage device is selectively coupled in parallel with different sets of the segments responsive to the varying voltage.

Additional embodiments of the inventive subject matter provide an apparatus including a rectifier circuit configured to be coupled to an AC source and to a string including at least two serially-connected LED segments. The rectifier circuit is configured to produce a rectified voltage from an AC voltage produced by the AC source. A segment control circuit is configured to selectively bypass at least one segment of the string responsive to the rectified voltage and an energy storage circuit is coupled to the rectifier circuit and configured to control current flow between at least one energy storage device and the string. A control circuit is configured to control the segment control circuit and the energy storage circuit such that the at least one energy storage device is charged by the rectifier circuit when a magnitude of the rectified voltage is greater than a threshold and discharged through less than all of the segments of the string when the magnitude of the rectified voltage is less than the threshold.

In further embodiments of the inventive subject matter, a lighting apparatus includes a string including at least two serially-connected LED segments and configured to be coupled to a source of a varying voltage. A segment control circuit is configured to selectively bypass at least one segment of the string responsive to the varying voltage. The apparatus further includes a dimming control circuit coupled to the segment control circuit and configured to control a current passing through at least one of the segments responsive to a dimming control input.

In some embodiments, the segment control circuit may include at least one current control circuit configured to control current flow from a node of the string responsive to a control signal and the dimming control circuit may be configured to generate the control signal. The dimming control circuit may be configured to generate the control signal responsive to a phase cut of an AC voltage.

BRIEF DESCRIPTION OF THE DRAWINGS

The accompanying drawings, which are included to provide a further understanding of the inventive subject matter and are incorporated in and constitute a part of this application, illustrate certain embodiment(s) of the inventive subject matter. In the drawings.

DETAILED DESCRIPTION

Figure 1:
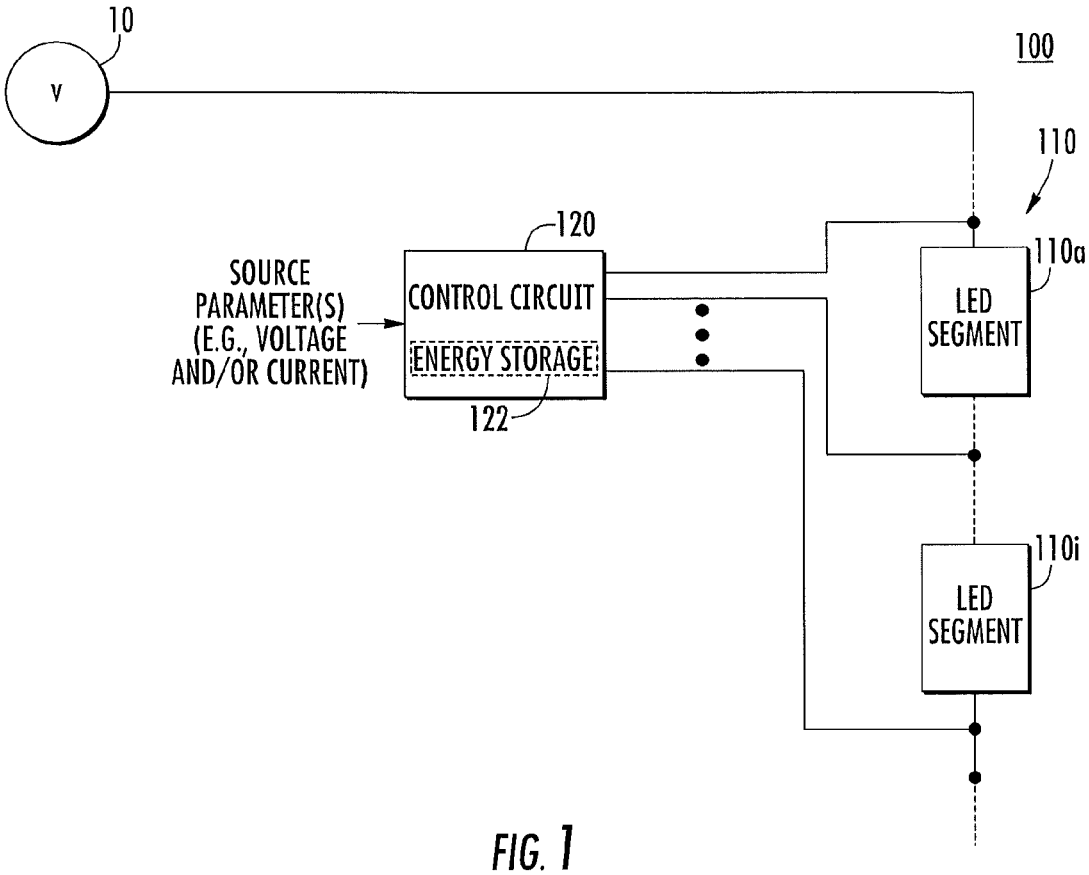
FIG. 1 is a block diagram illustrating a lighting apparatus according to some embodiments.

Embodiments of the present inventive subject matter now will be described more fully hereinafter with reference to the accompanying drawings, in which embodiments of the inventive subject matter are shown. This inventive subject matter may, however, be embodied in many different forms and should not be construed as limited to the embodiments set forth herein. Rather, these embodiments are provided so that this disclosure will be thorough and complete, and will fully convey the scope of the inventive subject matter to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. It will be further understood that elements "coupled in series" or "serially connected" may be directly coupled or may be coupled via intervening elements.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

The expression "lighting apparatus", as used herein, is not limited, except that it indicates that the device is capable of emitting light. That is, a lighting apparatus can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device. The present inventive subject matter may further relate to an illuminated enclosure (the volume of which can be illuminated uniformly or non-uniformly), comprising an enclosed space and at least one lighting apparatus according to the present inventive subject matter, wherein the lighting apparatus illuminates at least a portion of the enclosed space (uniformly or non-uniformly).

FIG. 1 illustrates a lighting apparatus 100 according to some embodiments of the inventive subject matter. The apparatus includes a string 110 of serially connected segments 110*a*, 110*i* of light emitting diodes (LEDs) coupled to a varying voltage source 10. The vary voltage source 10 may include, for example, a full-wave rectifier circuit that produces a time-varying voltage from an AC voltage source.

Each segment 110*a*, . . . , 110*i* may include one or more LEDs. The LEDs in each segment may be arranged in any of a variety of different parallel and/or serial combinations. For example, an individual segment may include multiple LEDs connected in series, multiple LEDs connected in parallel and/or multiple groups of parallel-connected LEDs coupled in series. The segments 110*a*, . . . , 110*i* may include equal numbers or LEDs or differing numbers of LEDs. The segments 110*a*, . . . , 110*i* may include the same type of LEDs or may include different types of LEDs, such as LEDs having different color, luminance, forward voltage or other characteristics.

The apparatus 100 further includes an energy-storing control circuit 120 including at least one energy-storage device 122 (e.g., one or more capacitors). The control circuit 120 is coupled to the string 110. According to some embodiments, the control circuit 120 is configured to couple the at least one energy storage device 122 in parallel with a first number of the segments 110*a*, . . . , 110*i* to charge the at least one energy storage device 122 and to discharge the at least one energy storage device 122 through a second number of the segments 110*a*, . . . , 110*i*. For example, in some embodiments, the first number of segments may be greater than the second number of segments. If the energy storage device 122 is a capacitor, for example, this may allow the capacitor to be charged to a relatively high voltage at a peak of the rectified voltage, and then discharged through a lesser number of the segments at or near nulls of the rectified voltage. In some embodiments, for example, such an arrangement may enable the use of relatively small and reliable ceramic capacitors instead of the relatively large and less reliable electrolytic capacitors used in some "valley fill" LED lighting circuits.

Figure 2:
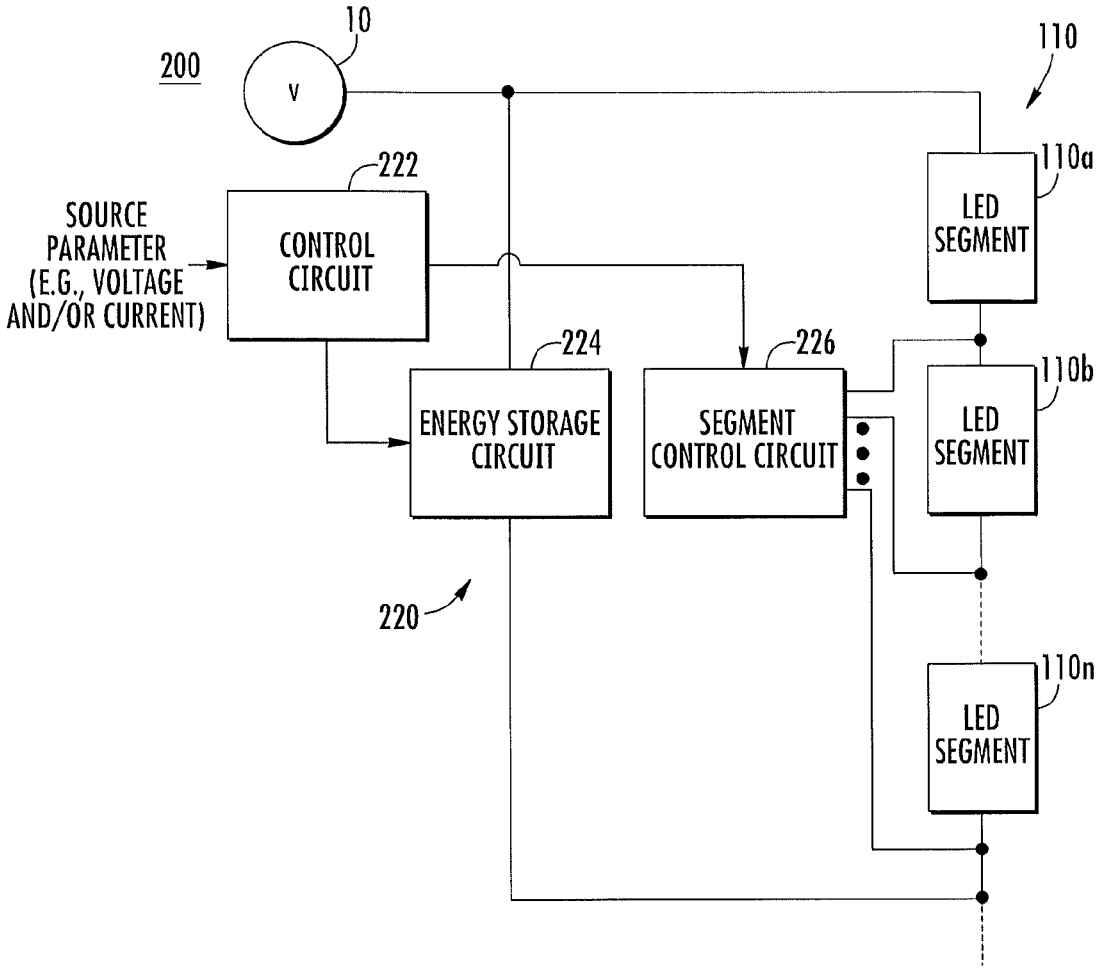
FIG. 2 is a block diagram illustrating a lighting apparatus according to further embodiments.

FIG. 2 illustrates a lighting apparatus 200 according to further embodiments. The apparatus 200 includes a string 110 of LED segments 110*a*, 110*b*, . . . , 110*n*, coupled to a varying voltage source 10. An energy storing control circuit 220 includes an energy storage circuit 224 and a segment control circuit 226 coupled to the string 110. A control circuit 222 controls the energy storage circuit 224 and the segment control circuit 226 responsive to one or more parameters of the source 10, such as a voltage and/or a current. In particular, the control circuit 222 may be configured to control the energy storage circuit 224 to charge and discharge at least one energy storage device thereof responsive to the one or more source parameters, and to control the segment control circuit 226 to selectively bypass the LED segments 110*a*, 110*b*, . . . , 110*n* in conjunction with these charging and discharging operations. For example, as explained below with reference to FIG. 4, the control circuit 222 may couple one or more energy storage devices (e.g., capacitors) of the energy storage circuit 224 in parallel with all of the LED segments 110*a*, 110*b*, . . . , 110*n* of the string 110 for a first voltage condition of the source 10 to support charging of the one or more energy storage devices, and to couple the one or more energy storage devices in parallel with a subset of the segments 110*a*, 110*b*, . . . , 110*n* of the string 110 for a second voltage condition of the source 10 to support discharging of the one or more energy storage devices through the subset of the segments 110*a*, 110*b*, . . . , 110*n*.

Figure 3:
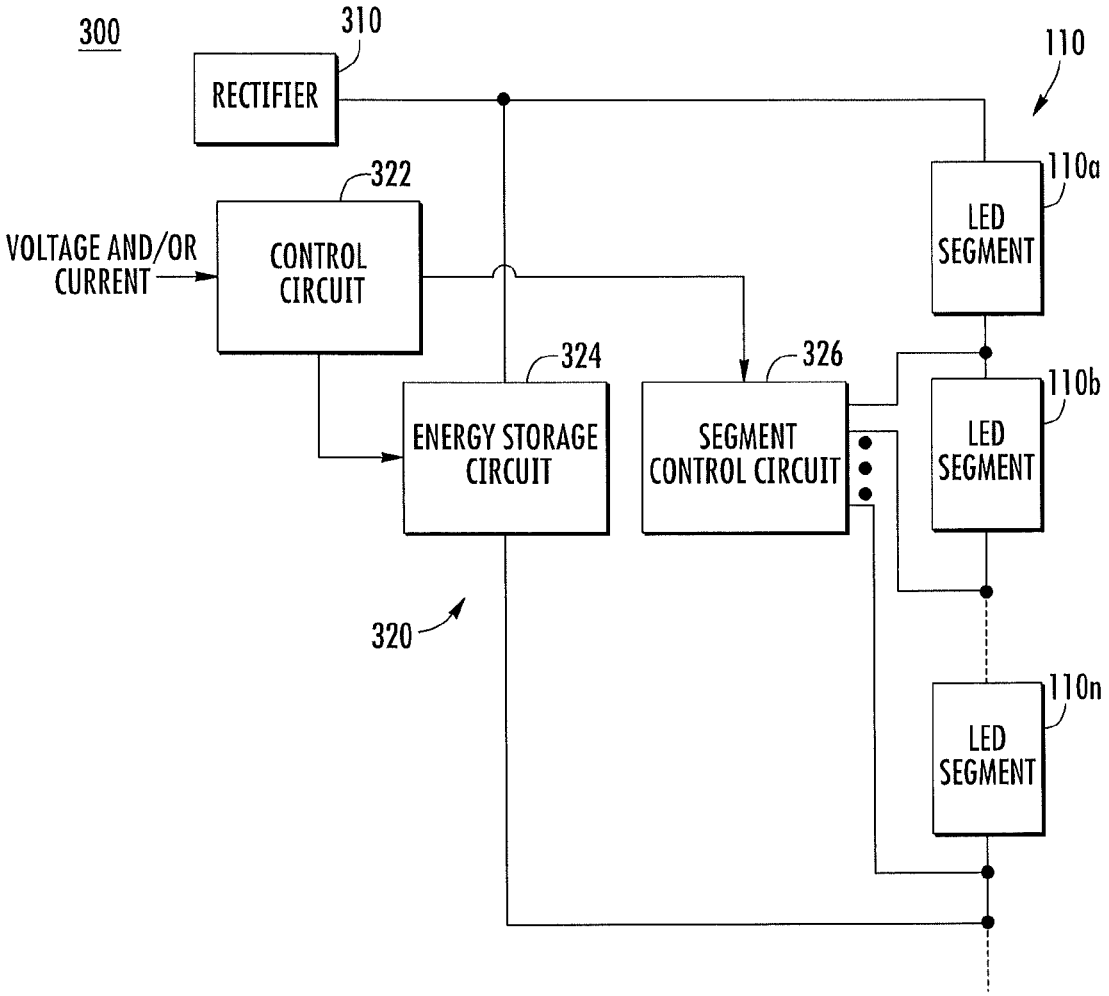
FIG. 3 is a block diagram illustrating a lighting apparatus according to still further embodiments.

FIG. 3 illustrates a lighting apparatus 300 according to further embodiments. The apparatus 300 includes a rectifier circuit 310 configured to generate a full-wave rectified voltage from an AC power source. A string 110 of LED segments 110*a*, 110*b*, . . . , 110*n* is coupled to the rectifier circuit 310. Under control of a control circuit 322, a segment control circuit 326 is configured to selectively bypass the segments 110*a*, 110*b*, . . . , 110*n* as the rectified voltage produced by the rectifier circuit 310 rises and falls. Such operations may use, for example, techniques described in U.S. patent application Ser. No. 13/235,127, entitled "Solid-State Lighting Apparatus and Methods Using Current Diversion Controlled by Lighting Device Bias States", filed Sep. 16, 2011, the disclosure of which is incorporated by reference herein in its entirety.

In conjunction with the operations of the segment control circuit 326, the control circuit 322 may also control an energy storage circuit 324 to charge and discharge at least one energy storage device (e.g., at least one capacitor) as the rectified voltage produced by the rectifier circuit 310 varies. In particular, when the rectified voltage is above a certain level (e.g., at a level sufficient to support forward conduction through at least one of the segments 110*a*, 110*b*, . . . , 110*n*), the control circuit 322 may control the energy storage circuit 324 to charge the at least one storage device while the LED string 110 is being driven by the rectified voltage. When the rectified voltage is below a certain level (e.g., at a level insufficient to cause forward conduction through at least one of the segments 110*a*, 110*b*, . . . , 110*n*), the control circuit 322 may control the energy storage circuit 324 and the segment control circuit 326 to discharge the at least one energy storage device of the energy storage circuit 324 through a subset of the LED segments 110*a*, 110*b*, . . . , 110*n*, such that illumination may be maintained when the rectified voltage is insufficient to drive at least one of the segments 110*a*, 110*b*, . . . , 110*n*.

Figure 4:
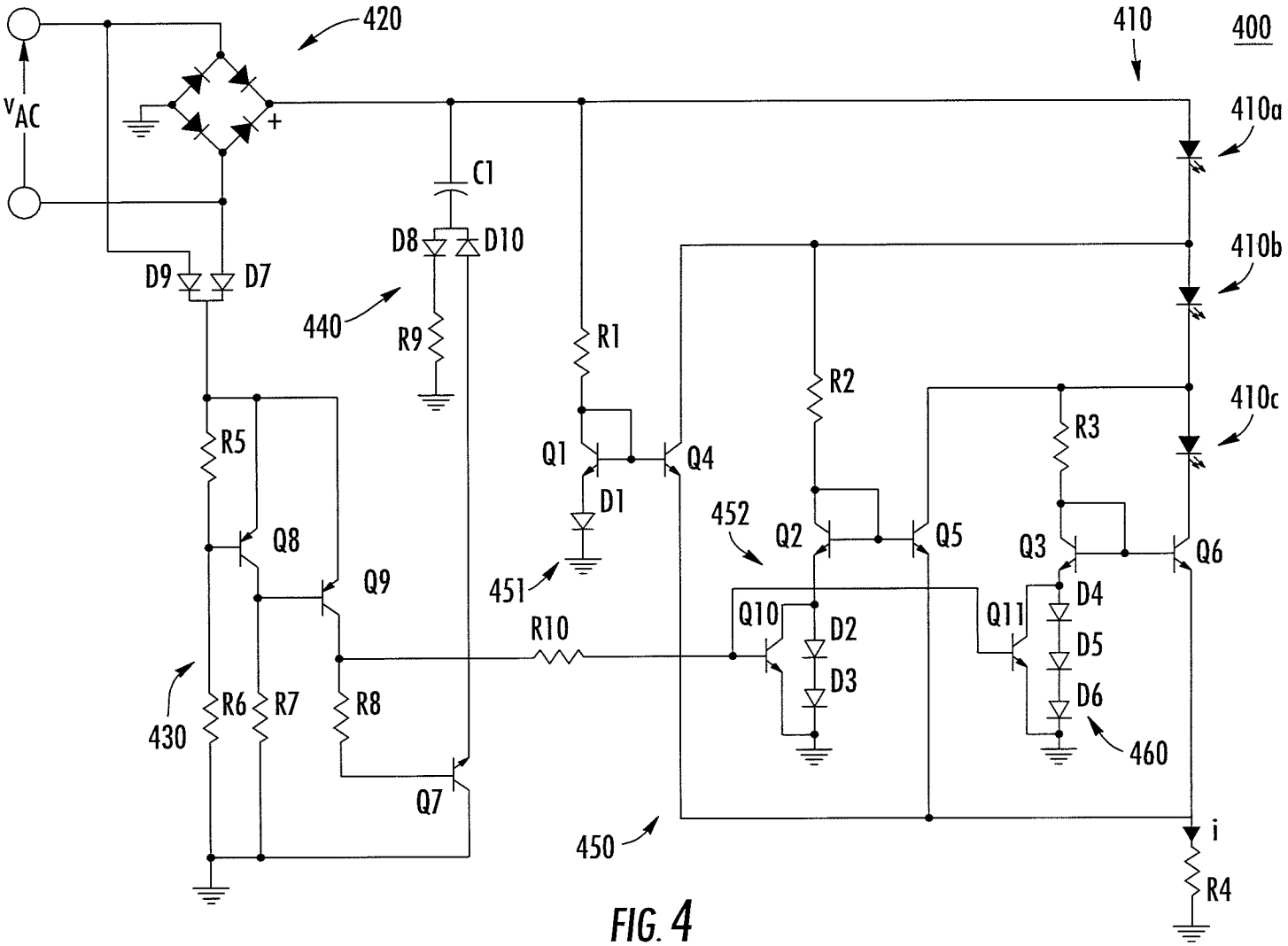
FIG. 4 is a circuit schematic diagram illustrating an implementation of the apparatus of FIG. 3 according to some embodiments.

FIG. 4 illustrates an exemplary circuit implementation of a lighting apparatus 400 along the lines of FIG. 3. The apparatus 400 includes a string 410 of three LED segments 410*a*, 410*b*, 410*c* coupled in series. One end of the string 410 is coupled to an output terminal of a rectifier circuit 420 comprising a diode bridge. An input port of the rectifier circuit 410 is configured to be coupled to an AC power source (e.g., a utility input) that produces an AC voltage $v_{AC}$.

A segment control circuit 450 is coupled to nodes of the string 410, and includes a first, second and third current control circuits 451, 452, 453, which are configured to selectively pass current from respective nodes of the string 410 to ground via a resistor R4 responsive to the rectified voltage produced by the rectifier circuit 420. The second and third current control circuits 452, 453 are controlled by a control circuit 430. The control circuit 430 is also coupled to an energy storage circuit 440.

The first current control circuit 451 includes first and second transistors Q1, Q4 arranged in a current mirror configuration, along with a resistor R1 and a diode D1. The second current control circuit 452 also includes first and second current mirror transistors Q2, Q5, which are biased by diodes D2, D3 and a resistor R2. The second current control circuit 452 further includes a transistor Q10 that receives a control signal from the control circuit 430 via a resistor R10. Similarly, the third current control circuit 453 includes first and second current mirror transistors Q3, Q6, diodes D4, D5, D6, a resistor R3 and a transistor Q11 that receives the control signal from the control circuit 430 via the resistor R10.

The energy storage circuit 440 includes a storage capacitor C1, diodes D8, D10, a resistor R9 and a transistor Q7. The transistor Q7 is controlled by a signal generated by the control circuit 430.

The control circuit 430 includes diodes D7, D9, which produce a rectified voltage from the AC source voltage $v_{AC}$. The control circuit 430 further includes a threshold circuit including transistors Q8, Q9 and resistors R5, R6, R7, R8. When the rectified voltage produced by the diodes D7, D9 is above a certain level, the threshold circuit turns off the transistor Q7 of the energy storage circuit 440, and the storage capacitor C1 is charged to a level approaching the level of the rectified voltage produced by the rectifier circuit 420. In particular, at or near the peak of the rectified voltage, the storage capacitor is coupled in parallel with all of the segments 410*a*, 410*b*, . . . , 410*n* of the LED string 410. In this state, the control circuit 430 turns off the transistors Q10, Q11 of the second and third current control circuits 452, 453 of the segment control circuit 450, so that the second and third current control circuits 452, 453 may respond to the rectified voltage, incrementally activating and deactivating the segments 410*a*, 410*b*, . . . , 410*n* of the string 410.

When the rectified voltage falls below the threshold level, the control circuit 430 turns on the transistor Q7 of the energy storage circuit 440, enabling current flow from the charged capacitor C1 to the LED string 410. Under this condition, the control circuit 430 turns on the transistors Q10, Q11 of the second and third current control circuits 452, 453, thus bypassing the second and third segments 410*b*, 410*c* of the string 410. Thus, the charged capacitor C1 is discharged only through the first segment 410*a*, supporting illumination when the rectified voltage is below the threshold. Generally, the threshold of the control circuit 430 may be set to a level that is at or near a level of the rectified voltage that is insufficient to support forward conduction through at least one of the segments 410*a*, 410*b*, 410*c*. If the voltage of the storage capacitor C1 does not exceed a level sufficient to turn off the third current control circuit 453, the transistor Q11 may be eliminated.

Figure 5:
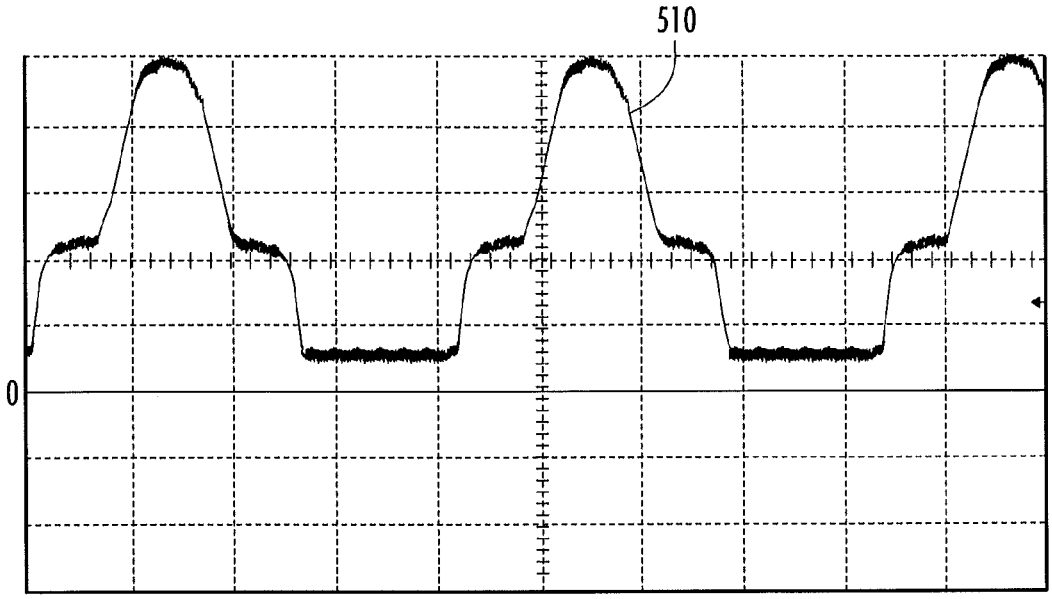
FIG. 5 is a waveform diagram illustrating operations of the circuit of FIG. 4.

FIG. 5 is a waveform diagram of a light output 510 that may be produced by the apparatus 400 of FIG. 4. As can be seen, the apparatus 400 may maintain a non-zero light output 510 at nulls of the rectified voltage. The light output 510 exhibits a stair-stepped characteristic associated with the operation of the segment control circuit 450 as the rectified voltage rises and falls.

Figure 6:
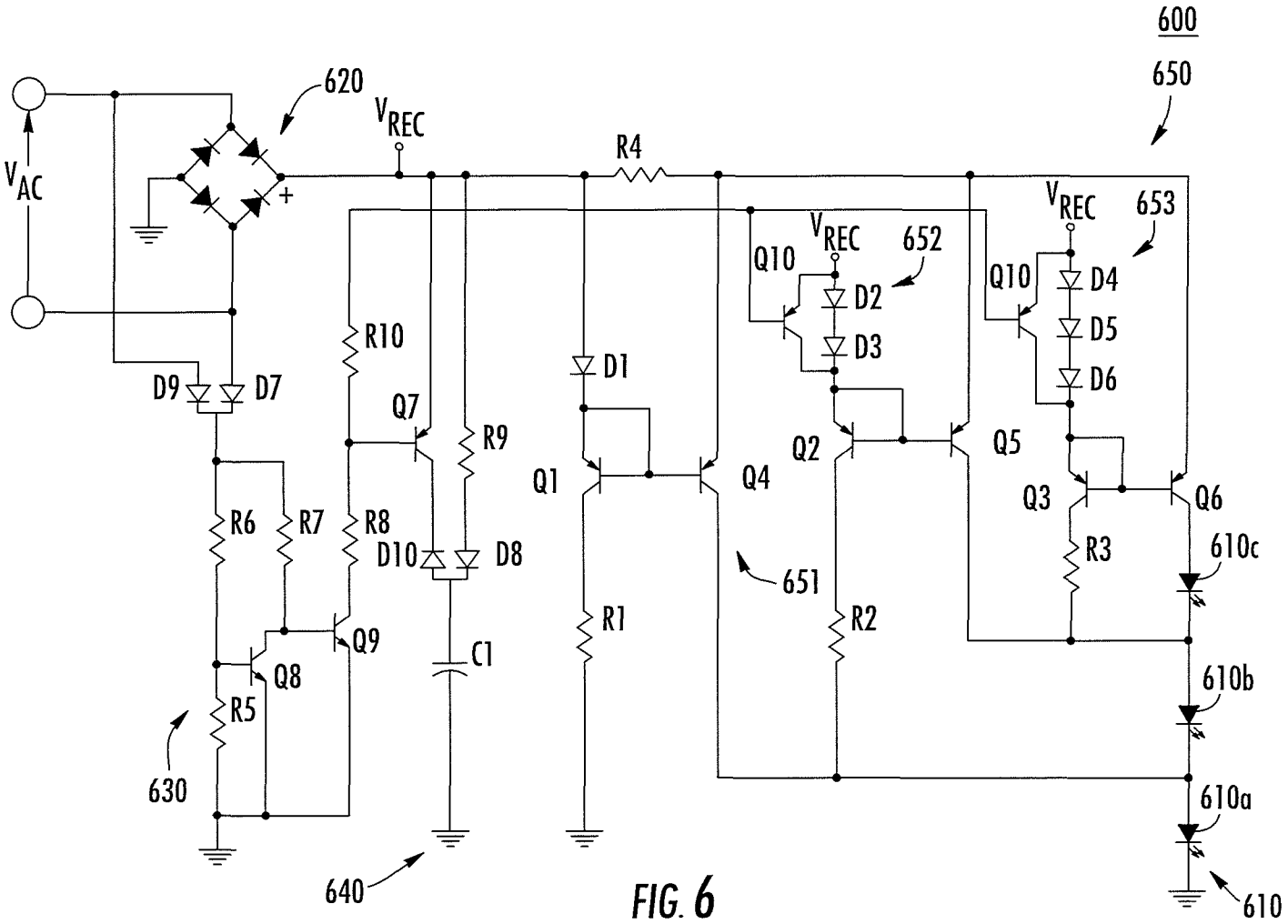
FIG. 6 is a circuit schematic diagram illustrating a lighting apparatus according to further embodiments.

FIG. 6 illustrates an apparatus 600 that includes a "dual" of the segment control circuit implementation illustrated in FIG. 4. The apparatus 600 includes a string 610 of LED segments 610*a*, 610*b*, 610*c*. A segment control circuit 650 includes first, second and third current control circuit 651, 652, 653, which are configured to selectively couple nodes of the string 610 to an output terminal of a rectifier circuit 620 via a resistor R4. An input port of the rectifier circuit 610 is configured to be coupled to an AC power source (e.g., a utility input) that produces an AC voltage $v_{AC}$. The second and third current control circuits 652, 653 are controlled by a control circuit 630. The control circuit 630 is also coupled to an energy storage circuit 640.

The first current control circuit 651 includes first and second transistors Q1, Q4 arranged in a current mirror configuration, along with a resistor R1 and a diode D1. The second current control circuit 652 also includes first and second current mirror transistors Q2, Q5, which are biased by diodes D2, D3 and a resistor R2. The second current control circuit 652 further includes a transistor Q10 that receives a control signal from the control circuit 630 via a resistor R10. Similarly, the third current control circuit 653 includes first and second current mirror transistors Q3, Q6, diodes D4, D5, D6, a resistor R3 and a transistor Q11 that receives the control signal from the control circuit 630 via the resistor R10.

The energy storage circuit 640 includes a storage capacitor C1, diodes D8, D10, a resistor R9 and a transistor Q7. The transistor Q7 is controlled by a signal generated by the control circuit 630.

The control circuit 430 includes diodes D7, D9, which produce a rectified voltage from the AC source voltage $v_{AC}$. The control circuit 430 further includes a threshold circuit including transistors Q8, Q9 and resistors R5, R6, R7, R8. When the rectified voltage produced by the diodes D7, D9 is above a certain level, the threshold circuit turns off the transistor Q7 of the energy storage circuit 640, and the storage capacitor C1 is charged to a level approaching the level of the rectified voltage produced by the rectifier circuit 620. In particular, at or near the peak of the rectified voltage, the storage capacitor is coupled in parallel with all of the segments 610*a*, 610*b*, . . . , 610*n* of the LED string 410. In this state, the control circuit turns off the transistors Q10, Q11 of the current control circuits 652, 653.

When the rectified voltage falls below the threshold level, the control circuit 630 turns on the transistor Q7 of the energy storage circuit 640, enabling current flow from the charged capacitor C1 to the LED string 610. Under this condition, the control circuit 630 turns on the transistors Q10, Q11 of the second and third current control circuits 652, 653, thus bypassing the second and third segments 610*b*, 610*c* of the string 610. Thus, the charged capacitor C1 is discharged only through the first segment 610*a*, supporting illumination when the rectified voltage is below the threshold. Generally, the threshold of the control circuit 630 may be set to a level that is at or near a level of the rectified voltage that is insufficient to support forward conduction through at least one of the segments 610*a*, 610*b*, 610*c*.

Figure 7:
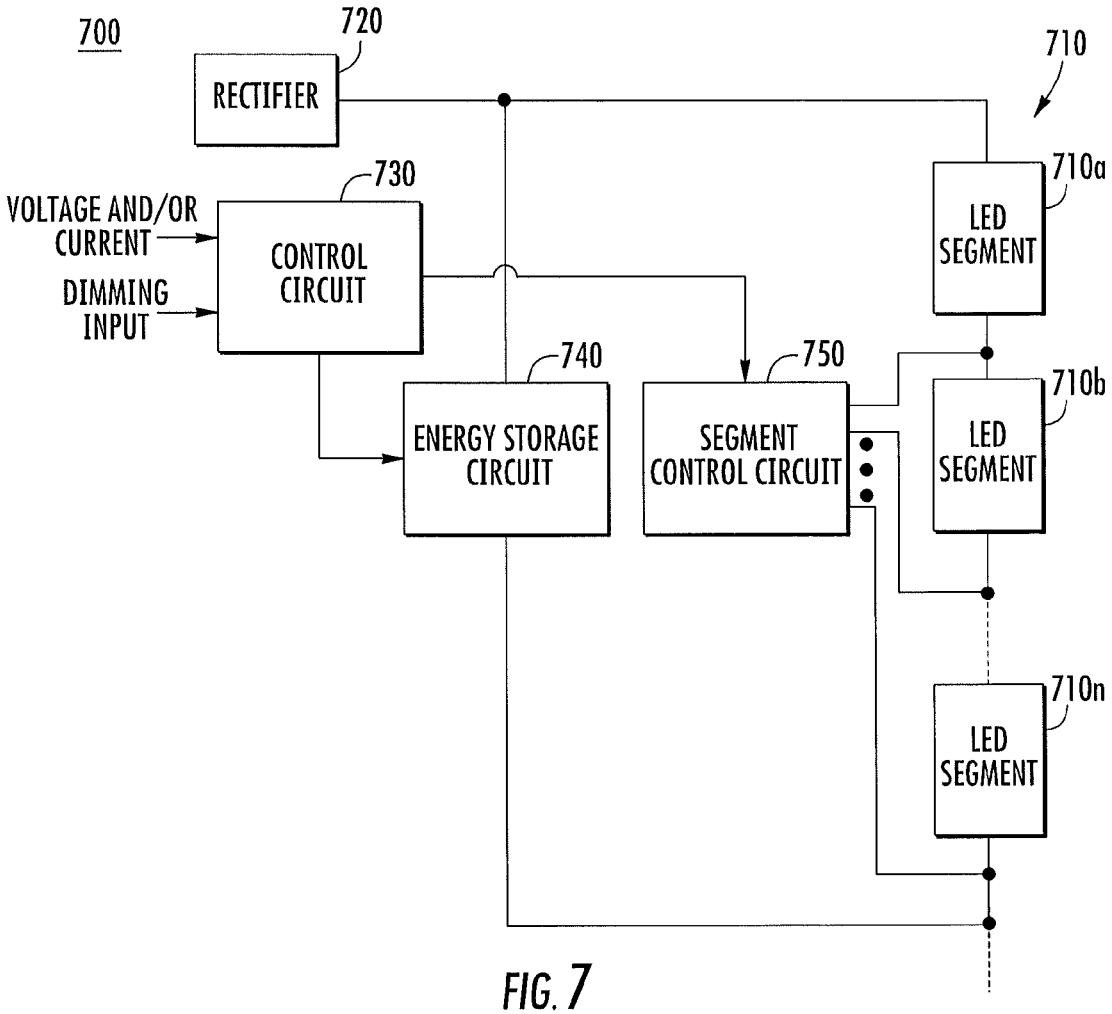
FIG. 7 is a block diagram illustrating a lighting apparatus according to further embodiments.

According to further embodiments of the inventive subject matter, lighting apparatus along the lines described above may also be configured to operate responsive to a dimming input. FIG. 7 illustrates a lighting apparatus 700 that includes a string 710 of LED segments 710*a*, 710*b*, . . . , 710*n* coupled to a rectifier circuit 720 configured to generate a full-wave rectified voltage from an AC input. Under control of a control circuit 730, a segment control circuit 750 is configured to selectively bypass the segments 710*a*, 710*b*, . . . , 710*n* as the rectified voltage produced by the rectifier circuit 720 rises and falls. In conjunction with the operations of the segment control circuit 750, the control circuit 730 may also control an energy storage circuit 740 to charge and discharge at least one energy storage device (e.g., at least one capacitor) as the rectified voltage produced by the rectifier circuit 720 varies, in a manner similar to that described above with reference to FIG. 3. As further illustrated the control circuit 730 may also control the energy storage circuit 740 and the segment control circuit 750 responsive to a dimming input. The dimming input may include, for example, an amount of phase cut applied by a phase cut dimmer circuit coupled to an input of the rectifier circuit 720 and/or a dimming signal (analog or digital) that provides similar dimming information.

Figure 8:
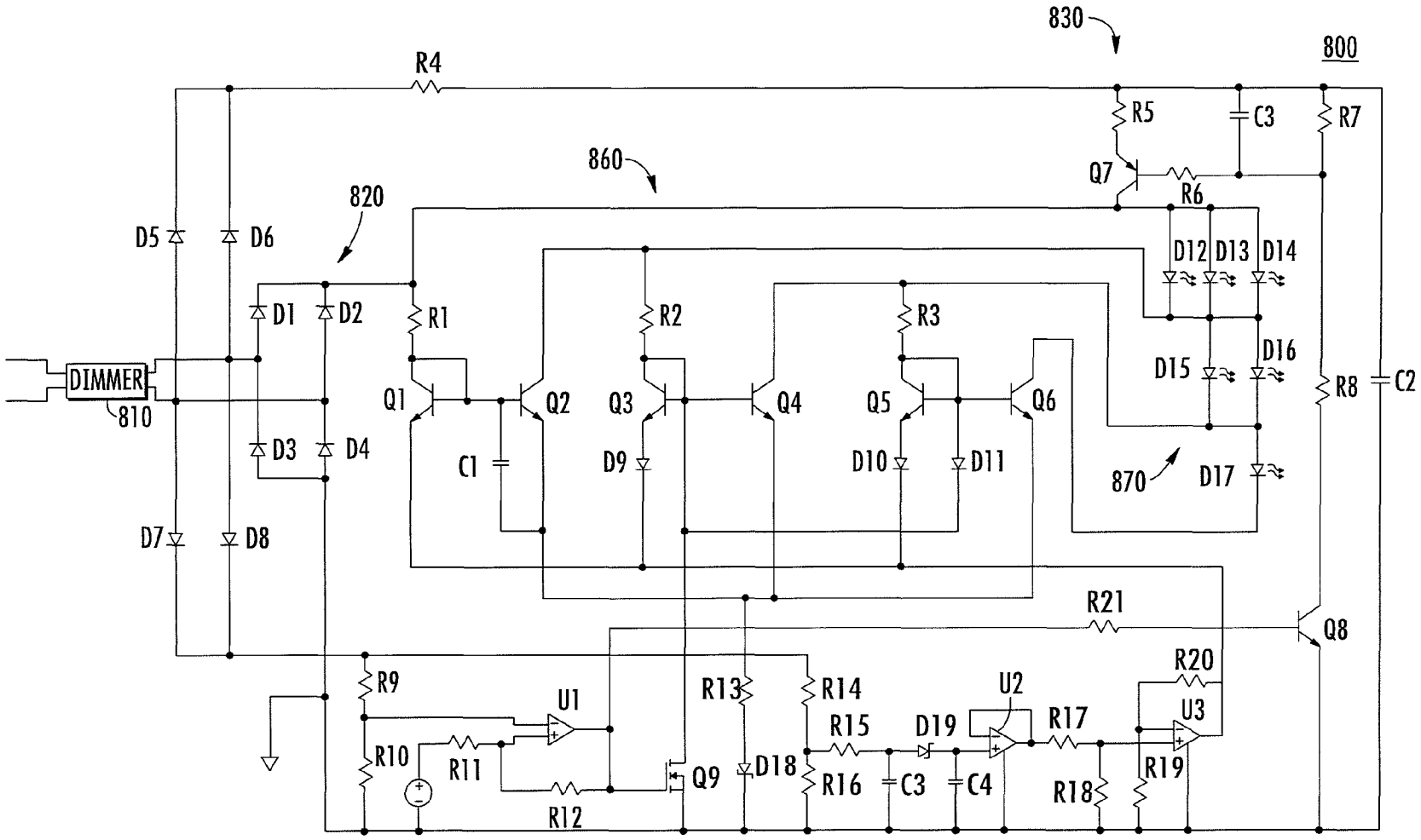
FIG. 8 is a circuit schematic diagram illustrating an implementation of the lighting apparatus of FIG. 7.

FIG. 8 illustrating a lighting apparatus 800 with such a dimming capability. The apparatus 800 includes a string 870 of LED segments, including a first segment comprising three LEDs D12, D13, D14, a second segment comprising two LEDs D15, D16, and a third segment including a single LED D17. The LED string 870 is coupled to a rectifier circuit 820 including four diodes D1, D2, D3, D4 connected in a bridge arrangement, and having an input coupled to a phase-cut dimmer circuit 810.

A segment control circuit 860 is configured to selectively bypass segments of the LED string 870. The segment control circuit includes a first current control circuit including transistors Q1, Q2 connected in a current mirror configuration and a resistor R1, a second current control circuit including current mirror transistors Q3, Q4, a resistor R2 and a diode D9, and a third current control circuit including current mirror transistors Q5, Q6, a resistor R3 and diodes D10, D11. The current control circuits pass current to ground via a resistor R13 and a diode D18.

An energy storage circuit 830 includes a storage capacitor C2 coupled through a resistor R4 to a first terminal of a rectifier coupled to the dimmer circuit 810 and including diodes D5, D6, D7, D8. The energy storage circuit 830 further includes transistors Q7, Q8, resistors R5, R6, R7, R8, and a capacitor C3. Responsive to a control signal applied to the transistor Q8 via a resistor R21, the energy storage circuit 830 is configured to charge the storage capacitor C2 from the output voltage of the dimmer circuit 810 and to discharge the charged storage capacitor C2 through the first segment (LEDs D12, D13, D14) of the LED string 870.

The control signal applied to the transistor Q8 is generated by a control circuit 840. The control circuit 830 includes a comparator U1, a transistor Q9 and resistors R9, R10, R11, R12, and has an input coupled to the rectifier comprising the diodes D5, D6, D7, D8. The control circuit 840 generates the control circuit for the energy storage circuit 830 based on the level of the output of the dimmer circuit 810.

As shown, the apparatus 800 further includes a dimming control circuit 850, including amplifiers U2, U3, resistors R14, R15, R16, R17, R18, R19, R20, diode D19 and capacitors C3, C4. The dimming control circuit 850 has an input coupled to the output of the dimmer circuit 810 via the rectifier diodes D7, D8 and is configured to generate an output signal that is representative of the dimming applied by the dimmer circuit 810, more particularly, a signal representative of an average magnitude of the output of the dimmer circuit 810. This output signal is applied to the current mirrors of the segment control circuit 860 to control the current flow therethrough, such that the currents flowing through the segments of the LED string 870 vary responsive to the dimming applied by the dimming circuit 810. The dimming is applied when the segments of the LED string 870 are being driven by the rectifier circuit 820 and when the first segment of the LED string 870 is being driven by a discharge of the storage capacitor C2.

In LED driver circuits employing segment control circuits along the lines discussed above, the input current may have a stepwise characteristic, as shown in FIG. 5. Such a characteristic may prevent such driver circuits from meeting harmonic requirements in some parts of the world. Harmonic distortion may be reduced using a segment control circuit arrangement along the lines illustrated in FIG. 9.

Figure 9:
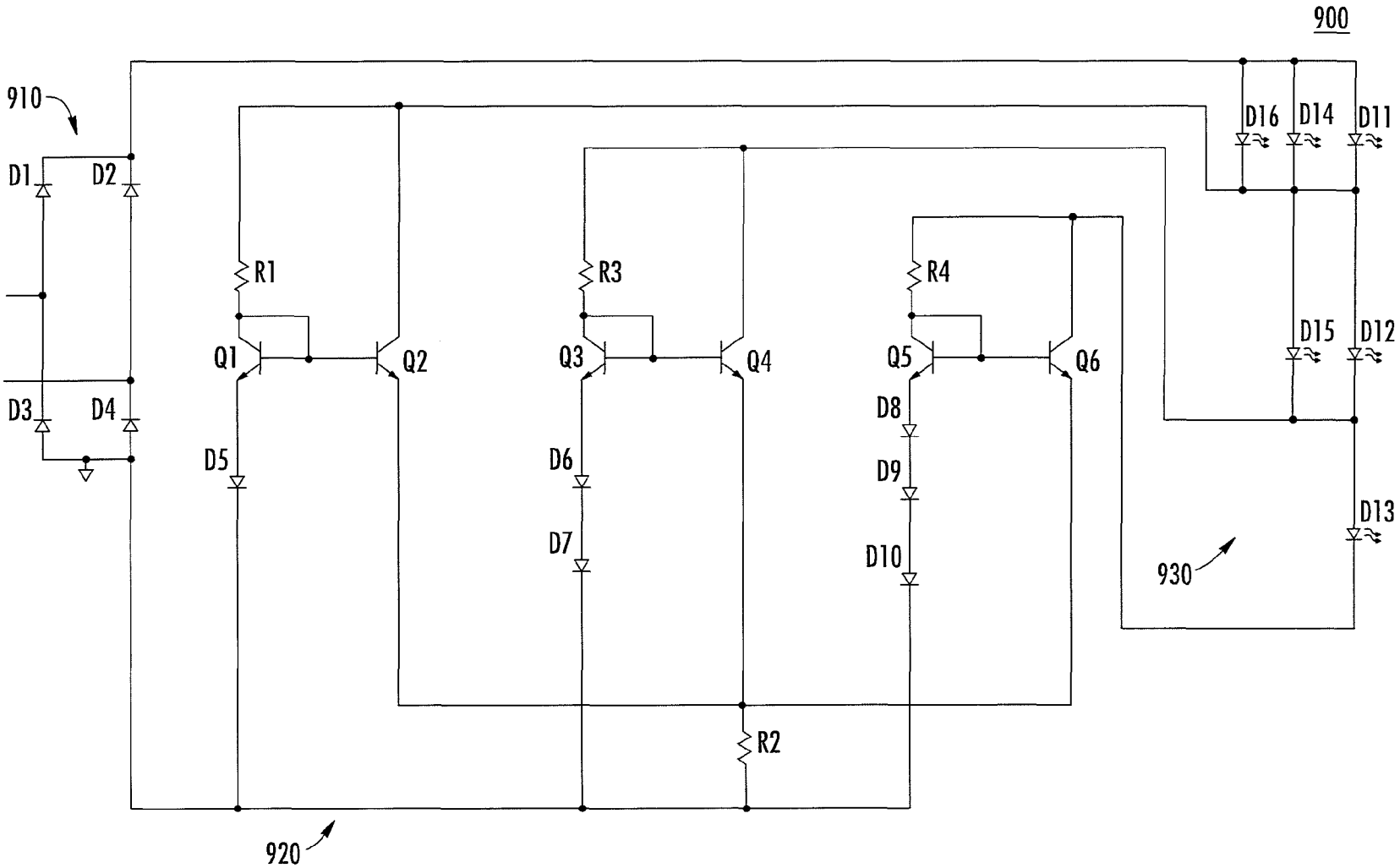
FIG. 9 is a circuit schematic diagram illustrating an implementation of a segment control circuit that may be used with the lighting apparatus of FIG. 7.
Figure 10:
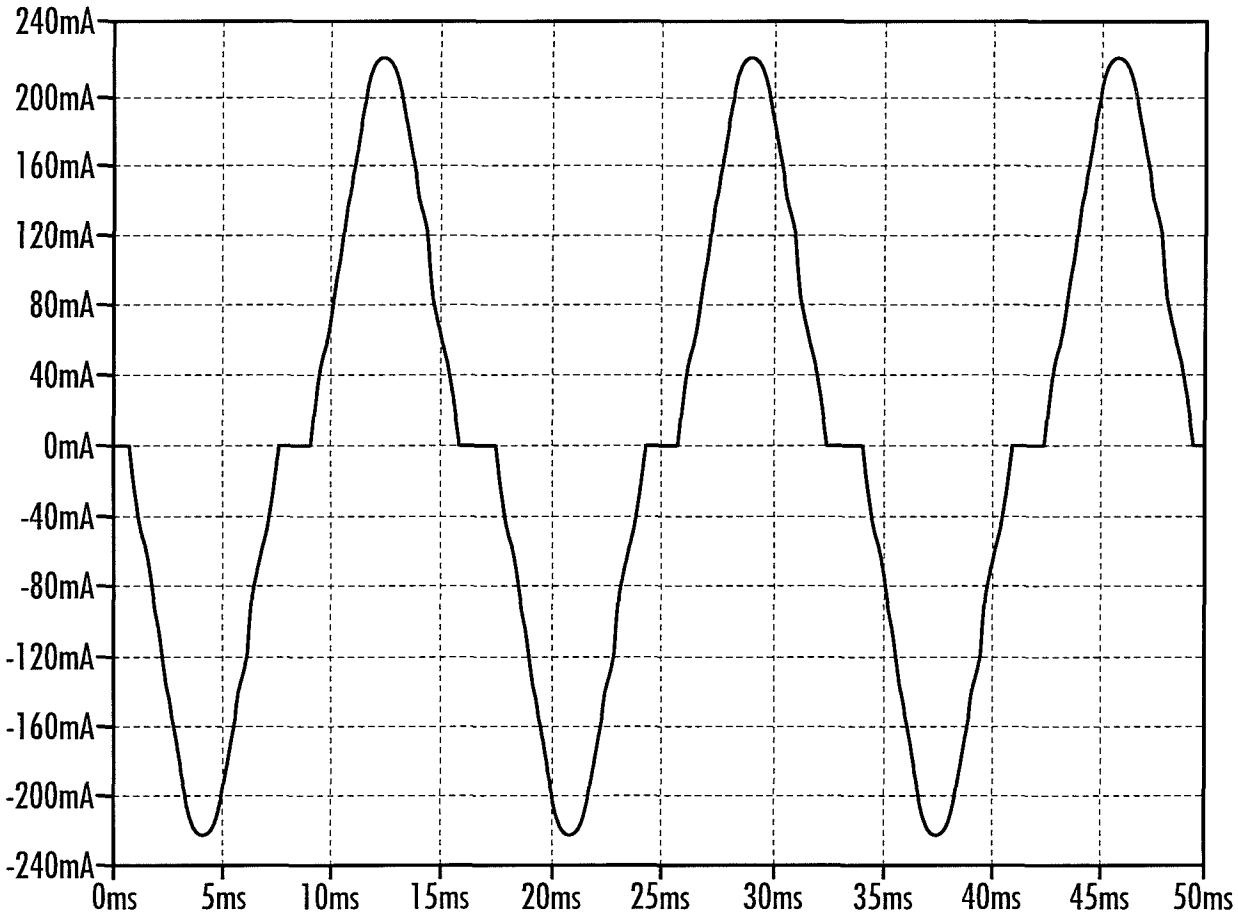
FIG. 10 is a waveform diagram illustrating operations of the circuit of FIG. 9.

Referring to FIG. 9, a lighting apparatus 900 may include a string 930 of LED segments, including a first segment of three diodes D11, D14, D16, a second segment with two diodes D12, D15 and a third segment with one diode D13. The string 930 is coupled to a rectifier circuit 910 including bridge diodes D1, D2, D3, D4. A segment control circuit 920 includes a first current control circuit including current mirror transistors Q1, Q2, a resistor R1 and a diode D5. A second current control circuit of the segment control circuit 920 includes current mirror transistors Q3, Q4, a resistor R3 and diodes D6, D7. A third current control circuit of the segment control circuit 920 includes current mirror transistors Q5, Q6, a resistor R4 and diodes D8, D9, D10. FIG. 10 illustrates input current for the apparatus 900 of FIG. 9, showing smoothed transitions as the current control circuits of the segment control circuit 920 operate. It will be appreciated that a segment control circuit arranged in the manner of the segment control circuit 920 may be used in lighting apparatus having the general architectures illustrated in FIGS. 1-3 and 7.

Embodiments of the inventive subject matter may be implemented in any of a variety of different forms, including, but not limited to lighting apparatus, such as lighting modules and fixtures, as well as control circuitry (e.g., integrated circuit devices, circuit modules and/or other devices) configured to be used in conjunction with LEDs and circuit components, such as storage capacitors, in such lighting apparatus.

Figure 11:
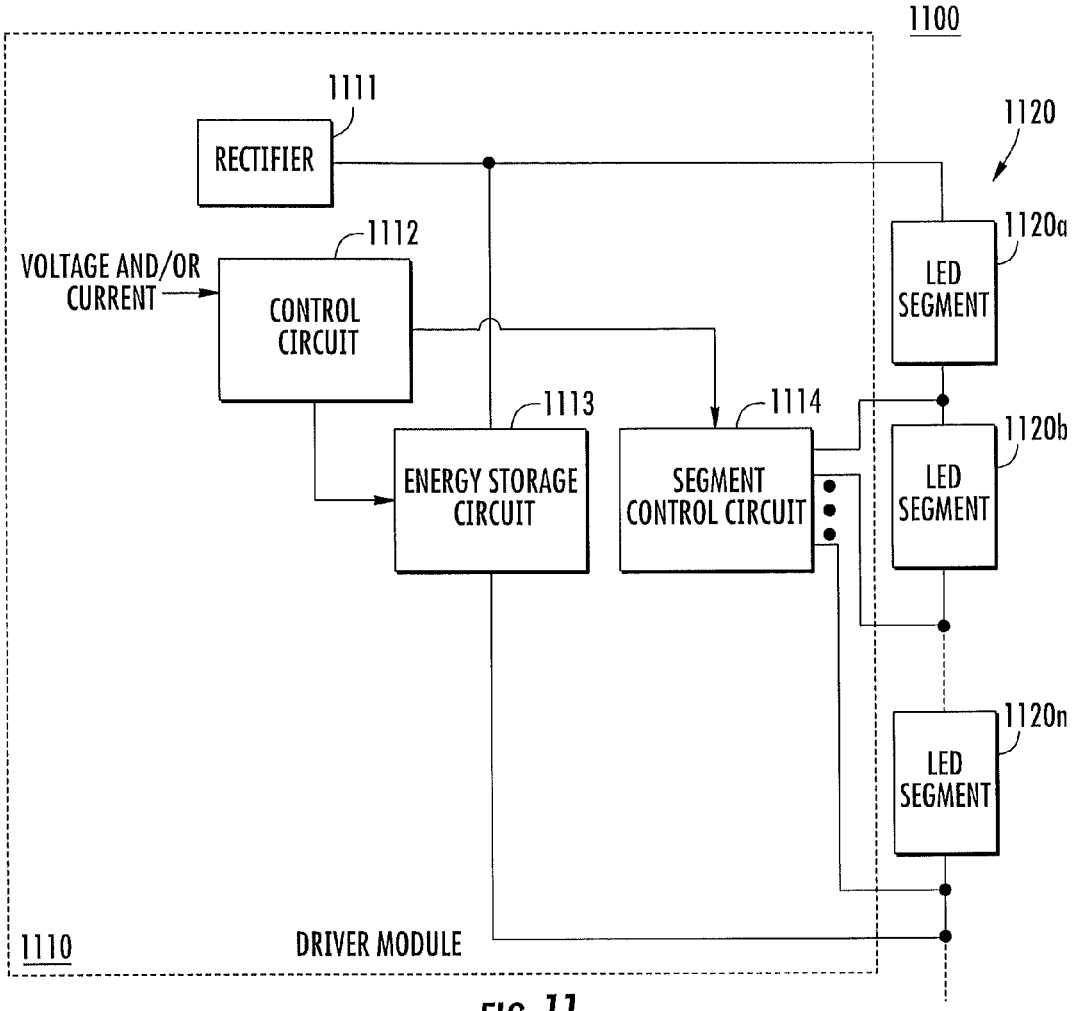
FIG. 11 is a block diagram illustrating an exemplary physical arrangement of the apparatus of FIG. 3 according to some embodiments.

For example, FIG. 11 illustrates a lighting apparatus 1100 including an LED string assembly 1120 comprising segments 1120*a*, 1120*b*, . . . , 1120*n*, and a driver module 1110 including circuitry for driving the string 1120. For example, the driver module 1100 may include a rectifier circuit 1111, a segment control circuit 1114, an energy storage circuit 1113 and a control circuit 1112. These circuits may operate along the lines described above.

Figure 12:
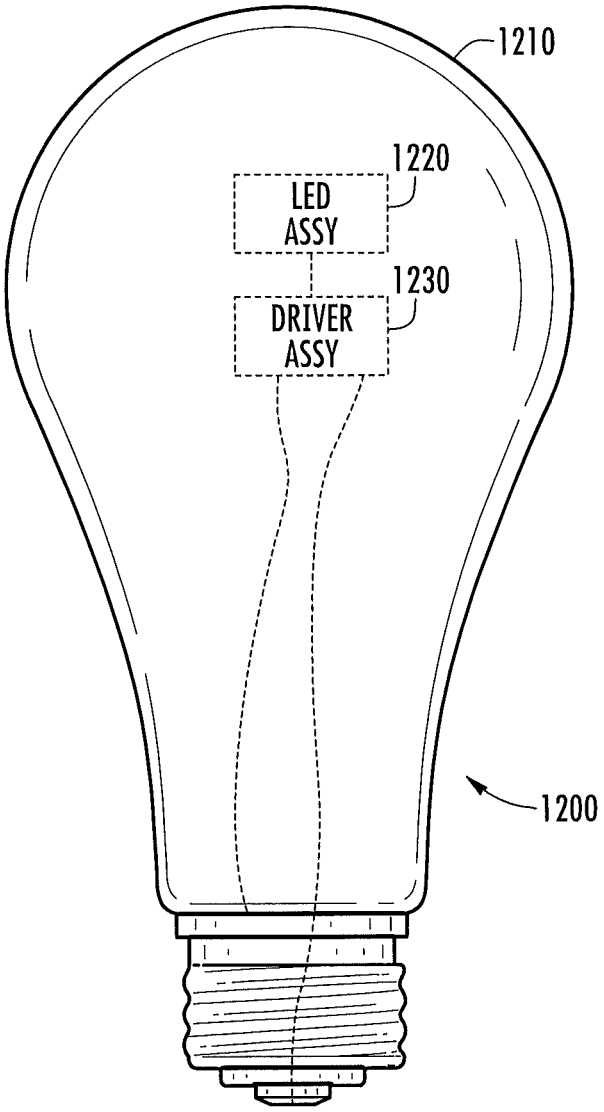
FIG. 12 is a diagram illustrating a lighting apparatus according to further embodiments.

As noted above, lighting apparatus according to some embodiments may be utilized in lighting fixtures, lamps and other assemblies. For example, FIG. 12 illustrates a lamp assembly 1200 according to some embodiments. The lamp assembly 1200 includes a transparent or semitransparent housing 1210, inside of which are positioned an LED assembly 1220 and a driver assembly 1230, for example, a driver module along the lines discussed above with reference to FIG. 11. The driver assembly 1230 is configured to receive AC power via a base connector (e.g., an Edison base or other standard lighting base) of the lamp assembly 1200. It will be appreciated that the implementation of FIG. 12 is offered for purposes of illustration, and that embodiments of the inventive subject matter may be implemented in a number of different ways in a number of different types of lighting assemblies, fixtures, and systems.

In the drawings and specification, there have been disclosed typical embodiments of the inventive subject matter and, although specific terms are employed, they are used in a generic and descriptive sense only and not for purposes of limitation, the scope of the inventive subject matter being set forth in the following claims.

What is claimed is:

1. A lighting apparatus comprising:

a string comprising at least two serially-connected light-emitting diode (LED) segments and configured to be coupled to a source of a varying voltage;

a segment control circuit configured to selectively bypass at least one segment of the string responsive to the varying voltage;

an energy storage circuit configured to charge at least one energy storage device from the source of varying voltage and to control current flow between the at least one energy storage device and the string; and a control circuit configured to cause the segment control circuit and the energy storage circuit to couple the at least one energy storage device in parallel with a first set of the at least two LED segments to charge the at least one charge storage device and to discharge the at least one charge storage device through a second set of the at least two LED segments.

2. The apparatus of claim 1, wherein the second set of segments comprises fewer segments than the first set of segments.

3. The apparatus of claim 1, wherein the second set of segments is a subset of the first set of segments.

4. The apparatus of claim 1, wherein the second set of segments comprises a segment having a greatest number of LEDs.

5. The apparatus of claim 4, wherein the second set of segments comprises a segment having a greatest number of LEDs connected in parallel.

6. The apparatus of claim 1, further comprising a rectifier circuit configured to be coupled to an AC source and to produce a rectified voltage from an AC voltage produced by the AC source, wherein the string is coupled to rectifier circuit, wherein the segment control circuit is configured to selectively bypass the segments of the string responsive to the rectified voltage and wherein the control circuit is configured to cause the segment control circuit to bypass at least one of the segments of the string when the rectified voltage is insufficient to cause forward conduction through at least one of the segments.

7. The apparatus of claim 6, wherein the control circuit is further configured to cause the energy storage circuit to provide current from the at least one energy storage device to at least one unbypassed segment of the string when the rectified voltage is insufficient to cause forward conduction through at least one of the segments.

8. The apparatus of claim 1, wherein the control circuit is configured to cause the energy storage circuit to charge the at least one energy storage device responsive to a magnitude of the varying voltage exceeding a threshold and to discharge the at least one energy storage device responsive to the magnitude of the varying voltage falling below the threshold.

9. The apparatus of claim 1, further comprising a dimming control circuit configured to control a current passing through at least one of the segments responsive to a dimming control input.

10. The apparatus of claim 9, wherein the segment control circuit comprises at least one current control circuit coupled to a node of the string and wherein the dimming control circuit is configured to control current flow through the at least one current control circuit.

11. The apparatus of claim 1, wherein the segments comprise different numbers of LEDs coupled in parallel.

12. A lighting apparatus comprising:

a rectifier circuit configured to be coupled to an AC source and to produce a rectified voltage from an AC voltage produced by the AC source;

a string comprising at least two serially-connected LED segments and configured to be coupled to the rectifier circuit;

a segment control circuit configured to selectively bypass at least one segment of the string responsive to the rectified voltage;

an energy storage circuit coupled to the rectifier circuit and configured to control current flow between at least one energy storage device and the string; and a control circuit configured to control the segment control circuit and the energy storage circuit such that the at least one energy storage device is charged by the rectifier circuit when a magnitude of the rectified voltage is greater than a threshold and discharged through a set of the segments of the string that includes less than all of the segments of the string when the magnitude of the rectified voltage is less than the threshold.

13. The apparatus of claim 12, wherein the segment control circuit is configured to support passing a current from the rectifier circuit through all of the segments in the string circuit at a peak of the rectified voltage and wherein energy storage circuit is configured to charge the at least one energy storage device to a voltage near the peak of the rectified voltage.

14. The apparatus of claim 12, wherein the segment control circuit comprises at least one current control circuit and wherein the control circuit is configured to control the segment control circuit to bypass at least one of the segments of the string when the rectified voltage is less than the threshold.

15. The apparatus of claim 12, further comprising a dimming control circuit coupled to the segment control circuit and configured to control a current passing through at least one of the segments responsive to a dimming control input.

16. The apparatus of claim 15, wherein the segment control circuit comprises at least one current control circuit coupled to a node of the string and configured to control current flow from the node responsive to a control signal and wherein the dimming control circuit is configured to generate the control signal.

17. The apparatus of claim 16, wherein the dimming control circuit is configured to generate the control signal responsive to a phase cut of the AC voltage.

18. An apparatus comprising:

a segment control circuit configured to be coupled to a string comprising at least two serially-connected LED segments, the segment control circuit configured to selectively bypass at least one segment of the string responsive to a varying voltage;

an energy storage circuit configured to charge at least one energy storage device from the source of varying voltage and to control current flow between the at least one energy storage device and the string; and a control circuit configured to cause the segment control circuit and the energy storage circuit to couple the at least one energy storage device in parallel with a first set of the at least two LED segments to charge the at least one charge storage device and to discharge the at least one charge storage device through a second set of the at least two LED segments.

19. The apparatus of claim 18, further comprising a rectifier circuit configured to be coupled to an AC source and to produce a rectified voltage from an AC voltage produced by the AC source, wherein the segment control circuit is configured to selectively bypass the segments of the string responsive to the rectified voltage and wherein the control circuit is configured to cause the segment control circuit to bypass at least one of the segments of the string when the rectified voltage is insufficient to cause forward conduction through at least one of the segments.

20. The apparatus of claim 19, wherein the control circuit is further configured to cause the energy storage circuit to provide current from the at least one energy storage device to at least one unbypassed segment of the string when the rectified voltage is insufficient to cause forward conduction through at least one of the segments.

21. The apparatus of claim 18, wherein the control circuit is configured to cause the energy storage circuit to charge the at least one energy storage device responsive to a magnitude of the varying voltage exceeding a threshold and to discharge the at least one energy storage device responsive to the magnitude of the varying voltage falling below the threshold.

22. The apparatus of claim 18, further comprising a dimming control circuit configured to control a current passing through at least one of the segments responsive to a dimming control input.

23. The apparatus of claim 22, wherein the segment control circuit comprises at least one current control circuit coupled to a node of the string and wherein the dimming control circuit is configured to control current flow through the at least one current control circuit.

24. The apparatus of claim 23, wherein the segment control circuit is configured to support passage of a current from the rectifier circuit through all of the segments in the string at a peak of the rectified voltage and wherein energy storage circuit is configured to charge the at least one energy storage device to a voltage near the peak of the rectified voltage.

25. The apparatus of claim 23, wherein the segment control circuit comprises at least one current control circuit and wherein the control circuit is configured to control the at least one current control circuit to bypass at least one of the segments of the string when the rectified voltage is less than the threshold.

26. The apparatus of claim 23, further comprising a dimming control circuit coupled to the segment control circuit and configured to control a current passing through at least one of the segments responsive to a dimming control input.

27. An apparatus comprising:

a rectifier circuit configured to be coupled to an AC source and to a string comprising at least two serially-connected LED segments and further configured to produce a rectified voltage from an AC voltage produced by the AC source;

a segment control circuit configured to selectively bypass segments of the string responsive to the rectified voltage;

an energy storage circuit coupled to the rectifier circuit and configured to control current flow between at least one energy storage device and the string; and a control circuit configured to control the segment control circuit and the energy storage circuit such that the at least one energy storage device is charged by the rectifier circuit when a magnitude of the rectified voltage is greater than a threshold and discharged through a set of the segments that includes less than all of the segments of the string when the magnitude of the rectified voltage is less than the threshold.

28. A lighting apparatus comprising:

a string comprising at least two serially-connected LED segments and configured to be coupled to a source of a varying voltage;

a segment control circuit configured to selectively bypass segments of the string responsive to the varying voltage; and a dimming control circuit coupled to the segment control circuit and configured to control a current passing through at least one of the segments responsive to a dimming control input.

29. The apparatus of claim 28, wherein the segment control circuit comprises at least one current control circuit configured to control current flow from a node of the string responsive to a control signal and wherein the dimming control circuit is configured to generate the control signal.

30. The apparatus of claim 29, wherein the dimming control circuit is configured to generate the control signal responsive to a phase cut of an AC voltage.

31. The apparatus of claim 30, wherein the control signal represents an average magnitude of the AC voltage.

32. A lighting apparatus comprising:

a string comprising at least two serially-connected LED segments and configured to be coupled to a source of a varying voltage;

a segment control circuit configured to selectively bypass segments of the string responsive to the varying voltage; and an energy storage circuit configured to charge at least one energy storage device from the source of varying voltage and to control current flow between the at least one energy storage device and the string; and a control circuit configured to control the segment control circuit and the energy storage circuit responsive to the varying voltage such that the at least one energy storage device is discharged through a set of the segments including less than all of the segments, wherein the energy storage circuit is configured to charge the at least one energy storage device to a voltage greater than a peak voltage of the set of the segments.

33. The apparatus of claim 32, wherein the control circuit is configured to discharge the at least one energy storage device through the set of the segments responsive to the varying voltage being insufficient to cause forward conduction through at least one of the segments.

34. The apparatus of claim 32, wherein the control circuit is configured to control the segment control circuit and the energy storage circuit to couple the at least one energy storage device in parallel with a first set of the segments to charge the at least one charge storage device and to discharge the at least one charge storage through a second set of the segments.

* * * * *